US010145508B2

(12) United States Patent
Kim et al.

(10) Patent No.: US 10,145,508 B2
(45) Date of Patent: Dec. 4, 2018

(54) FLUID STORAGE TANK WITH PLURALITY OF PARTITION PLATES

(71) Applicants: POSCO, Pohang-si, Gyeongsangbuk-do (KR); KOREA ADVANCED INSTITUTE OF SCIENCE AND TECHNOLOGY, Daejeon (KR)

(72) Inventors: Ki-Hwan Kim, Pohang-si (KR); Sung-Jin Lee, Pohang-si (KR); Do-Won Seo, Pohang-si (KR); Hyung-Jin Kim, Pohang-si (KR); Dae-Jun Chang, Daejeon (KR); Pal G. Bergan, Daejeon (KR)

(73) Assignees: POSCO, Pohang-si, Gyeongsangbuk-do (KR); Korea Advanced Institute of Science and Technology, Daejeon (KR)

( * ) Notice: Subject to any disclaimer, the term of this patent is extended or adjusted under 35 U.S.C. 154(b) by 47 days.

(21) Appl. No.: 15/108,235

(22) PCT Filed: Dec. 22, 2014

(86) PCT No.: PCT/KR2014/012633
§ 371 (c)(1),
(2) Date: Jun. 24, 2016

(87) PCT Pub. No.: WO2015/099374
PCT Pub. Date: Jul. 2, 2015

(65) Prior Publication Data

US 2016/0319992 A1 Nov. 3, 2016

(30) Foreign Application Priority Data

Dec. 24, 2013 (KR) ..... 10-2013-0162660

(51) Int. Cl.
*F17C 3/00* (2006.01)
*F17C 3/02* (2006.01)

(52) U.S. Cl.
CPC ..... *F17C 3/00* (2013.01); *F17C 3/022* (2013.01); *F17C 3/025* (2013.01);
(Continued)

(58) Field of Classification Search
CPC ..... F17C 2221/033; F17C 2260/016; F17C 2270/0105; F17C 2223/0161;
(Continued)

(56) References Cited

U.S. PATENT DOCUMENTS 2,379,126 A * 6/1945 Welden ..... B64D 37/06 211/184
2,552,119 A * 5/1951 Scharenberg ..... B64D 37/06 220/4.15
(Continued)

FOREIGN PATENT DOCUMENTS

CN 1134138 A 10/1996
CN 1922434 A 2/2007
(Continued)

OTHER PUBLICATIONS

Chinese Office Action dated Mar. 24, 2017 issued in Chinese Patent Application No. 201480071020.6 (with English translation).
(Continued)

*Primary Examiner* — Chun Cheung
*Assistant Examiner* — Brijesh V. Patel
(74) *Attorney, Agent, or Firm* — McDermott Will & Emery LLP

(57) ABSTRACT

A fluid storage tank according to an embodiment of the present invention comprises: a first outer wall section that forms a front face in the length direction, the width direction and the height direction so as to form a space portion in which a fluid is stored; a plurality of partition plates arranged along the length direction of the first outer wall portion to divide the space portion into the plurality of sub-space
(Continued)

portions; and an end portion located between the outermost partition plate of the plurality of partition plates and the first outer wall portion, wherein each of the partition plates is formed with a fluid through hole comprising: a gas through hole located on the top of the partition plate; and a liquid through hole located on the bottom of the partition plate so that fluids between the sub-pace portions are in communication with each other.

18 Claims, 4 Drawing Sheets

(52) U.S. Cl.
CPC ..... *F17C 2201/0157* (2013.01); *F17C 2201/0166* (2013.01); *F17C 2201/0171* (2013.01); *F17C 2201/035* (2013.01); *F17C 2201/052* (2013.01); *F17C 2203/012* (2013.01); *F17C 2203/013* (2013.01); *F17C 2203/0617* (2013.01); *F17C 2203/0629* (2013.01); *F17C 2203/0639* (2013.01); *F17C 2203/0646* (2013.01); *F17C 2203/0648* (2013.01); *F17C 2205/0379* (2013.01); *F17C 2209/221* (2013.01); *F17C 2221/033* (2013.01); *F17C 2223/0123* (2013.01); *F17C 2223/0161* (2013.01); *F17C 2223/033* (2013.01); *F17C 2223/035* (2013.01); *F17C 2260/011* (2013.01); *F17C 2260/013* (2013.01); *F17C 2260/016* (2013.01); *F17C 2260/018* (2013.01); *F17C 2270/01* (2013.01); *F17C 2270/011* (2013.01); *F17C 2270/0105* (2013.01); *F17C 2270/0113* (2013.01); *F17C 2270/0121* (2013.01); *F17C 2270/0123* (2013.01); *F17C 2270/0136* (2013.01)

(58) Field of Classification Search
CPC ..... F17C 2223/033; F17C 2203/012; F17C 2203/0629; F17C 2203/0636; F17C 2203/0648; F17C 2209/221; F17C 2201/0157; F17C 2201/0166; B21D 51/18; B21D 47/00; B65D 90/02; B65D 90/023; B65D 90/0066; B65D 90/12; B65D 90/52; B65D 88/02; B65D 88/10
USPC .... 220/4.28, 501, 507, 553, 560.04, 560.07, 220/560.1–560.11, 560.15, 562–563, 565, 220/584, 592, 646–647, 651, 653–654, 220/901; 114/74 A; 206/521
See application file for complete search history.

(56) References Cited

U.S. PATENT DOCUMENTS 3,477,606 A 11/1969 Schwendtner
3,979,005 A * 9/1976 Robinson ..... B64D 37/06 206/521
4,272,768 A * 6/1981 Rookard, Jr. ..... H01Q 15/18 215/12.2
4,550,848 A * 11/1985 Sucato ..... A45F 3/16 181/264
4,611,724 A * 9/1986 Watkins ..... B60P 3/221 220/553
4,858,778 A * 8/1989 Patrick ..... B64D 37/04 220/562
5,779,092 A * 7/1998 Hehn ..... B60P 3/224 137/574
5,960,981 A * 10/1999 Dodson ..... B65D 90/52 220/507
6,076,480 A * 6/2000 Chang, III ..... B63B 11/04 114/125
6,547,091 B2 * 4/2003 Hagenbuch ..... B60P 3/2235 137/576
6,595,382 B2 * 7/2003 Ettlinger ..... F17C 1/08 220/560.1
6,691,889 B1 * 2/2004 Falk ..... B60K 15/03 220/562
6,732,881 B1 * 5/2004 Gulati ..... B21D 47/00 220/560.04
2004/0188446 A1 9/2004 Gulati et al.
2007/0194051 A1 8/2007 Bakken et al.
2010/0045017 A1 * 2/2010 Rea ..... B65D 90/52 280/830
2010/0083671 A1 * 4/2010 Liner ..... B63B 25/16 62/53.2
2013/0146605 A1 * 6/2013 Ramoo ..... B65D 90/02 220/565

FOREIGN PATENT DOCUMENTS

CN 100436926 C 11/2008
EP 0718215 A1 6/1996
EP 0895017 A1 2/1999
EP 2035742 A1 3/2009
EP 2641009 A1 9/2013
JP S52-006490 B1 2/1977
JP 2002-521000 A 7/2002
JP 2008-503703 A 2/2008
JP 2009-541118 A 11/2009
KR 10-2007-0042536 A 4/2007
KR 10-2012-0072640 A 7/2012
KR 10-2012-0120862 A 11/2012
KR 10-2012-0120866 11/2012
KR 10-2013-0016725 A 2/2013
WO 98/21029 A1 5/1998
WO 2007/148982 A1 12/2007
WO 2012/148154 A2 11/2012

OTHER PUBLICATIONS

International Search Report issued in corresponding International Patent Application No. PCT/KR2014/012633, dated Jan. 15, 2015; 4 pages with English Language translation.
European Search Report dated Feb. 10, 2017 issued in European Patent Application No. 14875548.1.
Japanese Office Action dated Jul. 11, 2017 issued in Japanese Patent Application No. 2016-542758.

* cited by examiner

【Figure 1】
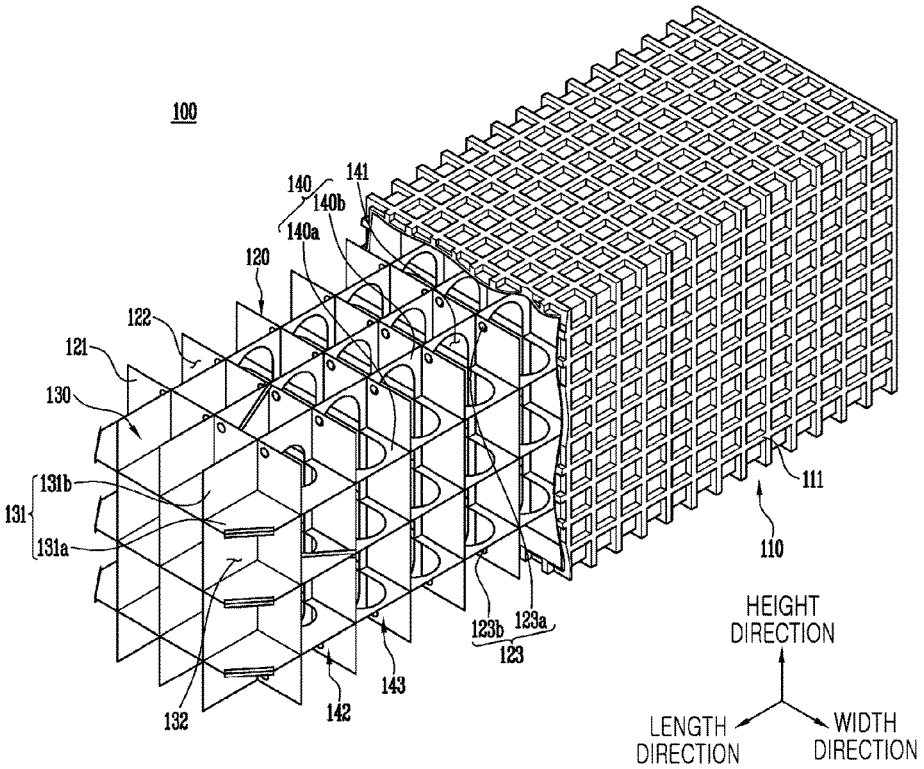

【Figure 2】
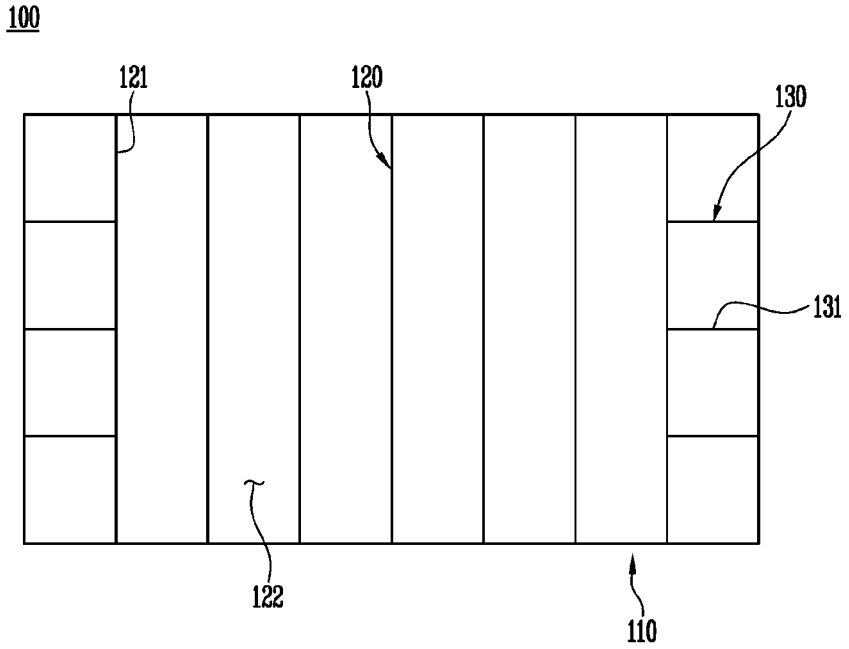
【Figure 3】
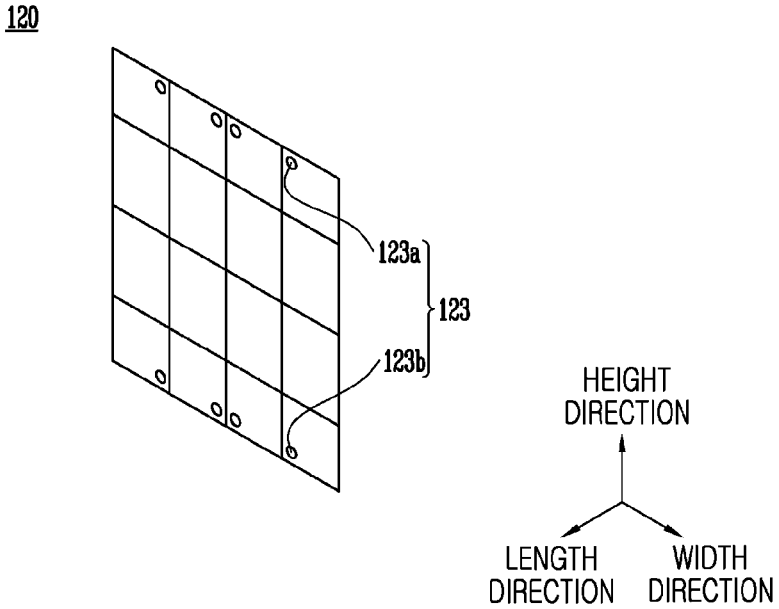

【Figure 4】
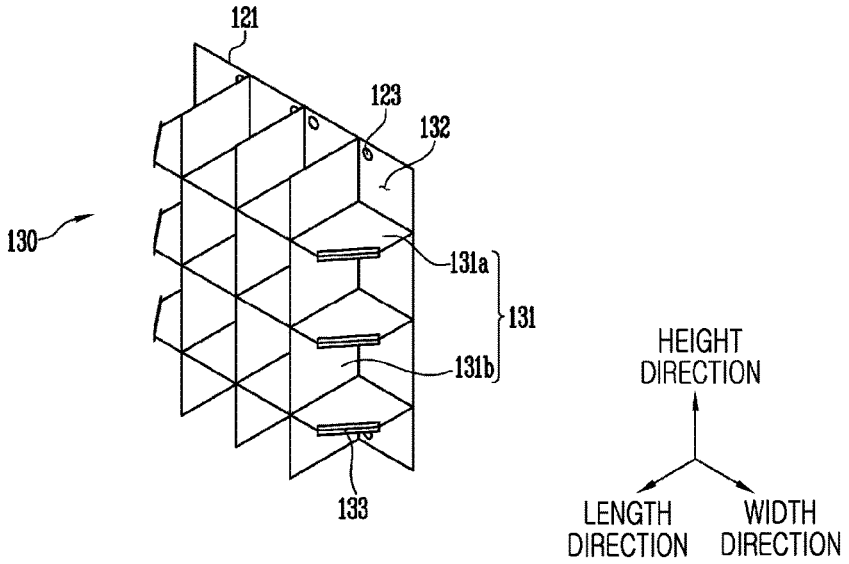
【Figure 5】
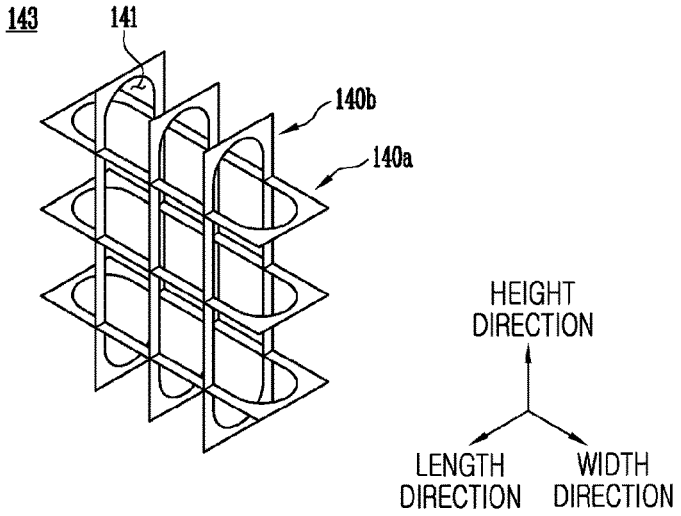

【Figure 6】
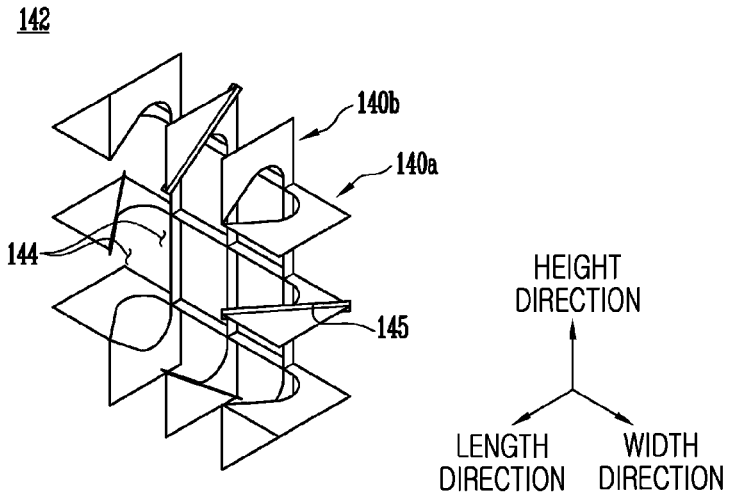
【Figure 7】
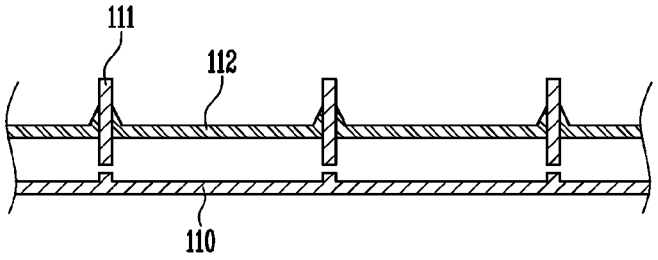

FLUID STORAGE TANK WITH PLURALITY OF PARTITION PLATES

RELATED APPLICATIONS

This application is the U.S. National Phase under 35 U.S.C. § 371 of International Patent Application No. PCT/KR 2014/012633, filed on Dec. 22, 2014, which in turn claims the benefit of Korean Patent Application No. 10-2013-0162660 filed on Dec. 24, 2013, the disclosures of which Applications are incorporated by reference herein.

TECHNICAL FIELD

The present disclosure relates to a fluid storage tank, and more particularly, to a fluid storage tank having an improved degree of strength.

BACKGROUND ART

Natural gas may be transferred through pipes by land or sea, or may be liquefied and transferred to remote destinations using liquefied natural gas (LNG) carriers. LNG is obtained by cooling natural gas to a very low temperature (about −163° C.), such that the volume of LNG is about 1/600 of the volume before liquefaction. Thus, LNG may be easily transferred to remote destinations by sea.

Since LNG has a very low temperature and high pressure, the role of LNG storage tanks is important. In addition to being used in LNG carriers, such fluid storage tanks may also be used in LNG Floating, Production, Storage, and Offloading (FPSO) facilities for liquefying and storing produced natural gas at sea and transferring stored LNG to LNG carriers, or in LNG Floating Storage and Regasification Units (FSRUs) installed on the sea far from land for receiving LNG from LNG carries, regasifying the LNG, and supplying the regasified LNG to land destinations.

Recently, there have been attempts to use LNG as a fuel for various means of transportation such as ocean-going vessels. In this case, LNG is stored in cylindrical storage tanks. However, since cylindrical storage tanks are small, many cylindrical storage tanks may be required, and thus a relatively large space of a vessel may be required to allow cylindrical storage tanks to be arranged at predetermined intervals.

DISCLOSURE

Technical Problem

An aspect of the present disclosure may provide a fluid storage tank having a high degree of spatial efficiency and a high degree of strength.

Technical Solution

According to an aspect of the present disclosure, a fluid storage tank may include: a first casing wall forming all outer sides of the fluid storage tank in length, width, and height directions, the first casing wall forming a cavity therein to store fluid; a plurality of partition plates arranged in the length direction of the first casing wall to divide the cavity into a plurality of sub-cavities; and end units disposed between the first casing wall and outermost partition plates of the plurality of partition plates, wherein fluid passage holes may be formed in the partition plates to allow the fluid to flow between the sub-cavities, and the fluid passage holes may include gas passage holes in upper regions of the partition plates and liquid passage holes in lower regions of the partition plates.

The liquid passage holes may be larger than the gas passage holes.

The end units may include reinforcing plate parts arranged to divide spaces between the first casing wall and the outermost partition plates into end spaces.

The reinforcing plate parts may divide the spaces between the first casing wall and the outermost partition plates in the height direction and the width direction.

The fluid may flow between the end spaces formed by the reinforcing plate parts through the fluid passage holes formed in the outermost partition plates.

The number of the fluid passage holes formed in the outermost partition plates may correspond to the number of the end spaces formed by the reinforcing plate parts.

Bracket units may be disposed between the partition plates adjacent to each other.

Parts of the bracket units may be arranged between the partition plates in the height and width directions.

Openings may be formed in the bracket units. The openings may have an arch shape on both ends thereof.

The bracket units may include: first bracket units disposed between the outermost partition plates and partition plates closest to the outermost partition plates; and second bracket units disposed between partition plates other than the outermost partition plates, wherein the first and second bracket units may have different shapes.

The first bracket units may be opened toward the outermost partition plates.

Flanges may be perpendicularly connected to the first bracket units.

Each of the bracket units may include: height bracket parts arranged between the partition plates in the height direction; and width bracket parts arranged between the partition plates in the width direction.

The fluid storage tank may further include a second casing wall enclosing the first casing wall.

The fluid storage tank may further include stiffeners inserted through the second casing wall with ends of the stiffeners being exposed.

Other ends of the stiffeners may be spaced apart from the first casing wall.

The first casing wall may have a size larger in the length direction than in the width or height direction.

The end units are respectively disposed on both lateral inner wall surfaces of the first casing wall.

Features and effects according to embodiments of the present disclosure will be clarified through the following description given with reference to the accompanying drawings.

Terms and words used in the description and claims should not be construed as being limited to general meanings or dictionary definitions, but should be construed according to the technical concepts and ideas of embodiments of the present disclosure based on the principle that inventors can define terms to properly describe their inventions.

Advantageous Effects

According to exemplary embodiments of the present disclosure, fluid may be stored in a single storage tank, and thus space may be efficiently used. In addition, the strength of the fluid storage tank may be increased using partition plates and end units.

In addition, according to the exemplary embodiments of the present disclosure, fluid passage holes may be formed in the partition plates, and thus fluid may flow between sub-cavities through the fluid passage holes. In addition, according to the exemplary embodiments of the present disclosure, a plurality of partition plates may be arranged inside a first casing wall, and thus sloshing may be reduced.

DESCRIPTION OF DRAWINGS

FIG. 1 is a perspective view illustrating a fluid storage tank according to an exemplary embodiment of the present disclosure.

FIG. 2 is a schematic cross-sectional view illustrating the fluid storage tank illustrated in FIG. 1.

FIG. 3 is a perspective view illustrating a partition plate of the fluid storage tank illustrated in FIG. 1.

FIG. 4 is a perspective view illustrating an outermost partition plate and an end unit of the fluid storage tank illustrated in FIG. 1.

FIG. 5 is a perspective view illustrating a second bracket unit of bracket units of the fluid storage tank illustrated in FIG. 1.

FIG. 6 is a perspective view illustrating a first bracket unit of the bracket units of the fluid storage tank illustrated in FIG. 1.

FIG. 7 is a cross-sectional view illustrating a portion of a fluid storage tank according to another exemplary embodiment of the present disclosure.

DESCRIPTION OF REFERENCE CHARACTERS

110: first casing wall, 111: stiffener
112: second casing wall, 120: partition plate
121: outermost partition plate, 122: sub-cavity
123: fluid passage hole, 130: end unit
131: reinforcing plate part, 140: bracket unit
141: opening, 144: opened region
145: vertical flange

BEST MODE

Purposes, effects, and features of embodiments of the present disclosure may be clearly understood through the following description given with reference to the accompanying drawings. In every possible case, like reference numerals are used for referring to the same or similar elements in the description and drawings. Moreover, detailed descriptions related to well-known functions or configurations will not be presented in order not to unnecessarily obscure subject matters of the present disclosure.

Hereinafter, exemplary embodiments of the present disclosure will be described with reference to the accompanying drawings.

FIG. 1 is a perspective view illustrating a fluid storage tank 100 according to an exemplary embodiment of the present disclosure, and FIG. 2 is a schematic cross-sectional view illustrating the fluid storage tank 100 illustrated in FIG. 1. Hereinafter, the fluid storage tank 100 will be described with reference to FIGS. 1 and 2 according to the exemplary embodiment of the present disclosure. The exterior of the fluid storage tank 100 of the exemplary embodiment is completely enclosed with a first casing wall 110. However, in FIG. 1, the first casing wall 110 is partially cut away for clarity of illustration and description.

As illustrated in FIGS. 1 and 2, the fluid storage tank 100 of the exemplary embodiment may include: the first casing wall 110 forming all outer sides of the fluid storage tank 100 in length, width, and height directions; a plurality of partition plates 120 arranged in the length direction of the first casing wall 110; and end units 130 disposed between inner wall surfaces of the first casing wall 110 and outermost partition plates 121. At least two fluid passage holes 123 may be formed in each of the partition plates 120.

The first casing wall 110 is a member forming the exterior of the fluid storage tank 100. The first casing wall 110 may form an inner cavity by enclosing all sides of the fluid storage tank 100 in the length, width, and height directions.

For example, fluid such as liquefied natural gas (LNG) or regasified LNG may be contained in the inner cavity of the first casing wall 110. In this case, for example, the first casing wall 110 may be formed of a cryogenic steel such as high-manganese (Mn) steel so as to contain the fluid at high pressure and low temperature. In addition, the first casing wall 110 may have a large thickness to contain a high-pressure fluid. However, if the first casing wall 110 is thick, manufacturing costs of the fluid storage tank 100 may increase. In addition, the weight and volume of the fluid storage tank 100 may increase. Therefore, according to the exemplary embodiment, stiffeners 111 may be connected to the first casing wall 110 to guarantee the stiffness of the first casing wall 110 while reducing the thickness of the first casing wall 110. The stiffeners 111 may have a shape such as an I, T, L, or U shape. The stiffeners 111 may be connected to inner surfaces of the first casing wall 110 as well as outer surfaces of the first casing wall 110. The first casing wall 110 may have a shape such as a rectangular parallelepiped shape, and each corner or edge of the first casing wall 110 may be angled or rounded.

In addition, reinforcing members such as manhole covers or tubes may be arranged on the first casing wall 110 to improve the stiffness of the first casing wall 110. Such manhole covers or tubes may be used instead of, or together with, the stiffeners 111, and may be arranged in regions in which the stiffeners 111 are not arranged. In addition, another structure may be additionally used to increase the stiffness of the first casing wall 110.

The fluid storage tank 100 of the exemplary embodiment may be disposed in a LNG carrier, an offshore floating structure, or a transportation means such as a vessel using LNG as a fuel. When a transportation means uses LNG as a fuel, cylindrical fuel tanks may be used to store LNG because cylindrical fuel tanks have a high degree of strength. However, for example, eight fuel tanks having a storage volume of 500 $m^3$ may be required to provide a fuel storage volume of 4000 $m^3$. When the size of fuel tanks and intervals between the fuel tanks are considered, a space of 36 m (length)×47.6 m (width)×6 m (height) may be required to arrange eight cylindrical fuel tanks. Since means of transportation such as vessels have limited space, using such a large space for fuel tanks may decrease spatial efficiency.

However, the fluid storage tank 100 of the exemplary embodiment is a single large tank enclosed by the first casing wall 110. Thus, for example, when disposed in a vessel, the fluid storage tank 100 may occupy a relatively small space and thus may improve the spatial efficiency of the vessel. For example, when a fuel storage volume of 4000 $m^3$ is required, the fluid storage tank 100 of the exemplary embodiment may only occupy an installation space of 36 m (length)×16 m (width)×8 m (height), thereby improving spatial efficiency compared to the case of using cylindrical fuel tanks of the related art. When the fluid storage tank 100 is constructed as a single large tank as described above, the length of the fluid storage tank 100 may be greater than the width and height of the fluid storage tank 100. Therefore, the fluid storage tank 100 may have to be reinforced. To this end, the partition plates 120 and the end units 130 are used in the exemplary embodiment.

FIG. 3 is a perspective view illustrating one of the partition plates 120 of the fluid storage tank illustrated in FIG. 1. Hereinafter, the partition plates 120 of the fluid storage tank 100 will be described with reference to FIGS. 1 to 3 according to the exemplary embodiment.

If the first casing wall 110 is filled with fluid in a state in which the first casing wall 110 is not reinforced using additional members, the strength of the first casing wall 110 may be insufficient, and thus the thickness of the first casing wall 110 may have to be increased. However, although the thickness of the first casing wall 110 is increased, if LNG is filled in the first casing wall 110, the strength of the first casing wall 110 may not be sufficient. In addition, if a vessel rolls from side to side (in the length direction of the fluid storage tank 100) at sea, fluid filled in the first casing wall 110 may fluctuate. The fluctuation of fluid may apply impact force to the first casing wall 110 and damage the first casing wall 110. This phenomenon is known as sloshing. Sloshing relates to the volume of fluid storage space, and if the volume of fluid storage space is reduced, sloshing may decrease.

Thus, in the exemplary embodiment, the partition plates 120 are disposed inside the first casing wall 110. The partition plates 120 may be arranged in the length direction of the first casing wall 110 to divide the inner cavity of the first casing wall 110 into a plurality of sub-cavities 122. Therefore, each space in which fluid is contained may be reduced in volume because the inner cavity is divided into sub-cavities, and thus sloshing may decrease. In addition, stress may also decrease in the length direction of the fluid storage tank 100. That is, the fluid storage tank 100 may be effectively reinforced. In this case, the partition plates 120 may be spaced apart from each other in the length direction of the fluid storage tank 100, and the intervals between the partition plates 120 may be uniform or different in some regions. For example, if reinforcement is less required in a region of the first casing wall 110, the partition plates 120 may be arranged at relatively large intervals in the region so as to reduce the number of the partition plates 120 and the weight of the fluid storage tank 100. In addition, since the partition plates 120 connect mutually-facing inner wall surfaces of the first casing wall 110, expansion of the first casing wall 110 in directions opposite the partition plates 120 may be suppressed, and thus the resistance to pressure of the fluid storage tank 100 may be increased in the width and length directions of the fluid storage tank 100. In addition, since the partition plates 120 reinforce the first casing wall 110, the first casing wall 110 may be less vibrated when a pump or an engine of a vessel engine is operated. Each of the partition plates 120 may extend inside the first casing wall 110 in the width and height directions of the first casing wall 110 and may be fixed to inner wall surfaces of the first casing wall 110 by a method such as welding.

As illustrated in FIG. 3, at least two fluid passage holes 123 may be formed in each of the partition plates 120, and thus the sub-cavities 122 containing a fluid may be connected to each other. The fluid passage holes 123 may include gas passage holes 123*a* and liquid passage holes 123b. The gas passage holes 123*a* may be formed in upper regions of the partition plates 120 to allow gas to flow between the sub-cavities 122, and the liquid passage holes 123*b* may be formed in lower regions of the partition plates 120 to allow liquid to flow between the sub-cavities 122. Owing to the fluid passage holes 123, fluid may freely flow between the sub-cavities 122, and thus fluid may be easily filled in the fluid storage tank 100 and discharged from the fluid storage tank 100. For example, when fluid is filled in the fluid storage tank 100 or discharged from the fluid storage tank 100, even though a tube is connected to only one of the sub-cavities 122, the fluid may flow to or from the other sub-cavities 122. Therefore, the number of facilities such as pumps, pump towers, tubes may be reduced, and thus the fluid storage tank 100 may be manufactured at low cost and may be easily used and managed. In addition, since the gas passage holes 123*a* and the liquid passage holes 123*b* are separately formed, when liquid flows out from one of the sub-cavities 122, gas may flow into the sub-cavity 122 through the gas passage holes 123*a* in a direction opposite the outflow direction of liquid, and when liquid flows into the sub-cavity 122, gas may flow out from the sub-cavity 122 through the gas passage holes 123*a* in a direction opposite the inflow direction of liquid. Therefore, the same pressure may be applied to the sub-cavities 122. The liquid passage holes 123*b* may be formed to have a size larger than the size of the gas passage holes 123*a* by taking the properties of liquids and gases into consideration. That is, this size relationship between the gas passage holes 123*a* and the liquid passage holes 123*b* may be useful to balance the rate of inflow and the rate of outflow and obtain a uniform pressure distribution.

FIG. 4 is a perspective view illustrating one of the outermost partition plates 121 and one of the end units 130 of the fluid storage tank illustrated in FIG. 1. Hereinafter, the end units 130 will be described with reference to FIGS. 1 to 4 according to the exemplary embodiment of the present disclosure.

As described above, stress generated in the length direction of the first casing wall 110 may be reduced to some degree owing to the partition plates 120. However, the fluid storage tank 100 may receive higher pressure in the length direction than in the width and height directions. Thus, if a particular structure is not provided on an end or both ends of the first casing wall 110, the first casing wall 110 may be deformed by internal pressure. Therefore, in the exemplary embodiment, the end units 130 are provided to reinforce both ends of the first casing wall 110 and prevent deformation of the first casing wall 110.

In detail, the end units 130 are disposed between inner wall surfaces of the first casing wall 110 and the outermost partition plates 121 of the partition plates 120. The end units 130 may include reinforcing plate parts 131 to divide spaces located between the first casing wall 110 and the outermost partition plates 121. For example, the reinforcing plate parts 131 may include: height reinforcing plate parts 131*a* horizontally oriented and arranged in the height direction; and width reinforcing plate parts 131*b* vertically oriented and arranged in the width direction. Therefore, each of the spaces between the first casing wall 110 and the outermost partition plates 121 may be divided into end spaces 132, and the number of the end spaces 132 may be equal to the product of the number of the height reinforcing plate parts 131*a*+1 and the number of the width reinforcing plate parts 131*b*+1. That is, as illustrated in FIG. 4, if three height reinforcing plate parts 131*a* and three width reinforcing plate parts 131*b* are provided, sixteen end spaces 132 may be formed.

At both sides of the fluid storage tank 100, the end units 130 including the reinforcing plate parts 131 are disposed on outer sides of the outermost partition plates 121. Therefore, the fluid storage tank 100 may more effectively withstand pressure acting in the length direction of the fluid storage tank 100. Furthermore, according to the exemplary embodiment, the end units 130 of the fluid storage tank 100 include the height reinforcing plate parts 131*a* and the width reinforcing plate parts 131*b* that are not parallel but cross each other at right angles, and thus the stiffness of the fluid storage tank 100 may be further increased compared to the case in which the end units 130 only include either the height reinforcing plate parts 131*a* or the width reinforcing plate parts 131*b*. Particularly, since the pressure of gas acts in all directions)(360°, the two-direction support structure by the height reinforcing plate parts 131*a* and the width reinforcing plate parts 131*b* may be effective in withstanding pressure of gas. In addition, the end units 130 may prevent deformation of the first casing wall 110 by reinforcing the first casing wall 110, and since the spaces between the first casing wall 110 and the outermost partition plates 121 are divided into smaller spaces (end spaces 132) by the end units 130, sloshing may be more effectively prevented. In addition, flanges 133 may be perpendicularly connected to the reinforcing plate parts 131 of the end units 130 so as to effectively reinforce the end units 130.

Although not illustrated, the outermost partition plates 121 may include more fluid passage holes 123. For example, the outermost partition plates 121 may include fluid passage holes 123 respectively corresponding to the end spaces 132. For example, in the case illustrated in FIG. 4, each of the outermost partition plates 121 may include nine fluid passage holes 123. Since the spaces between the first casing wall 110 and the outermost partition plates 121 are divided into the end spaces 132 by the reinforcing plate parts 131, the number of the fluid passage holes 123 may be set to correspond to the number of the end spaces 132 to allow fluid to flow between the end spaces 132.

In the exemplary embodiment, the reinforcing plate parts 131 of the end units 130 are arranged in the height and width directions. However, the reinforcing plate parts 131 may be arranged in diagonal directions. In addition, the reinforcing plate parts 131 may not cross each other at right angles.

FIG. 5 is a perspective view illustrating a second bracket unit 143 of bracket units 140 of the fluid storage tank 100 illustrated in FIG. 1, and FIG. 6 is a perspective view illustrating a first bracket unit 142 of the bracket units 140 of the fluid storage tank 100 illustrated in FIG. 1. Hereinafter, the bracket units 140 of the fluid storage tank 100 will be described with reference to FIGS. 1 to 6 according to the exemplary embodiment of the present disclosure.

As described above, stress generated in the length direction of the first casing wall 110 may be reduced owing to the partition plates 120. The reason for this is that stress is distributed to the partition plates 120 to some degree. However, stress may locally increase at joint portions between the first casing wall 110 and the partition plates 120. To address this, the thickness of the first casing wall 110 may be increased or the number of the partition plates 120 may be increased. However, this method is not economical. Thus, according to the exemplary embodiment, the bracket units 140 may be disposed between the partition plates 120 to decrease stress in the joint portions between the first casing wall 110 and the partition plates 120. The bracket units 140 may include first bracket units 142 and second bracket units 143 having different shapes. For ease of description, the second bracket units 143 will be first described below.

The second bracket units 143 may be disposed between the partition plates 120 except for the outermost partition plates 121 so as to reinforce the first casing wall 110 and the partition plates 120. As illustrated in FIG. 5, each of the second bracket units 143 may include relatively large openings 141 to allow fluid to freely flow between the sub-cavities 122. The openings 141 may have an arch shape in directions toward ends of the partition plates 120. In this case, the openings 141 of the second bracket units 143 of the bracket units 140 may have a continuously varying angle (contour) and may not have a region sharply angled with respect to the first casing wall 110, and thus stress may be more effectively reduced. In addition, owing to the openings 141 formed in the second bracket units 143, the second bracket units 143 may not be too heavy. In addition, the second bracket units 143 may divide the sub-cavities 122 to some degree, and thus sloshing may be further prevented. In addition, the second bracket units 143 may reduce or prevent vibration of the partition plates 120 caused by an external vibration source such as a pump. For example, each of the second bracket units 143 may include height bracket parts 140*a* arranged between the partition plates 120 in the height direction; and width bracket parts 140*b* arranged between the partition plates 120 in the width direction. Each of the height bracket parts 140*a* may extend in the width direction, and each of the width bracket parts 140*b* may extend in the height direction. The height bracket parts 140*a* and the width bracket parts 140*b* arranged between the partition plates 120 may reduce stress in the height, width, and length directions. This three-dimensional structure of the second bracket units 143 may effectively withstand pressure of gas acting in all directions (360°). Each of the second bracket units 143 may be jointed to two adjacent partition plates 120 and inner wall surfaces of the first casing wall 110 through a process such as a welding process. In the exemplary embodiment, parts of the second bracket units 143 are arranged in the height and width directions. However, parts of the second bracket units 143 may be arranged in diagonal directions. In addition, parts of the second bracket units 143 may not cross each other at right angles.

The first bracket units 142 are disposed between the outermost partition plates 121 and partition plates 120 closest to the outermost partition plates 121. That is, the first bracket units 142 are disposed inside the end units 130. For example, as illustrated in FIG. 6, each of the first bracket units 142 may include height bracket parts 140*a* and width bracket parts 140*b* to reinforce the partition plates 120 and the first casing wall 110. As illustrated in FIGS. 5 and 6, the first bracket units 142 may have a shape different from the shape of the second bracket units 143. The reason for this is as follows. Since the first bracket units 142 are adjacent to the end units 130, a relatively large amount of stress may be formed in portions of the first bracket units 142 facing the outermost partition plates 121. Thus, the first bracket units 142 are shaped to withstand a middle level of stress between levels of stress in the second bracket units 143 and the end units 130. To this end, opened regions 144 may be formed in the portions of the first bracket units 142 facing the outermost partition plates 121 to effectively transmit lengthwise stress to the end units 130. Since the first bracket units 142 are subject to higher stress than the second bracket units 143, vertical flanges 145 may be provided on both the height bracket parts 140*a* and the width bracket parts 140*b* of the first bracket units 142 so as to guarantee the stiffness of the first bracket units 142. The flanges 145 may have a shape such an I shape, a T shape, or an L shape. In the exemplary embodiment, parts of the first bracket units 142 are arranged in the height and width directions. However, parts of the first bracket units 142 may be arranged in diagonal directions. In addition, parts of the first bracket units 142 may not cross each other at right angles.

FIG. 7 is a cross-sectional view illustrating a portion of a fluid storage tank according to another exemplary embodiment of the present disclosure. Hereinafter, the fluid storage tank will be described with reference to FIG. 7 according to the other exemplary embodiment of the present disclosure. In the current embodiment, elements identical or similar to those described in the previous embodiment are denoted by the same reference numerals, and repeated descriptions thereof will be omitted.

As illustrated in FIG. 7, the fluid storage tank of the current embodiment may further include a second casing wall 112 outside a first casing wall 110. The second casing wall 112 may enclose the first casing wall 110 so as to more effectively reinforce the fluid storage tank and prevent the leakage of fluid even when fluid leaks through the first casing wall 110. In addition, stiffeners 111 may be inserted into the second casing wall 112. In this case, ends of the stiffeners 111 may be exposed to the outside, and the other ends of the stiffeners 111 may face the first casing wall 110. The stiffeners 111 may not contact the first casing wall 110. That is, the stiffeners 111 may be spaced apart from the first casing wall 110. In this case, a region between the first casing wall 110 and the second casing wall 112 may be managed as a single space, and thus if fluid leaks through the first casing wall 110, the leakage of fluid may be easily detected.

While exemplary embodiments have been shown and described above, the exemplary embodiments are for illustrative purposes only are not intended to limit the fluid storage tanks to the exemplary embodiments. That is, it will be apparent to those skilled in the art that modifications and variations could be made without departing from the spirit and scope of the present invention.

Simple modifications and variations made from the exemplary embodiments should be construed as being included in the scope of the present invention, and the scope of the present invention should be defined by the following claims.

The invention claimed is:

1. A fluid storage tank comprising:

a first casing wall forming all outer sides of the fluid storage tank in length, width, and height directions, the first casing wall forming a cavity therein to store fluid;

a plurality of partition plates arranged in the length direction of the first casing wall to divide the cavity into a plurality of sub-cavities; and end units disposed between the first casing wall and outermost partition plates of the plurality of partition plates, wherein fluid passage holes are formed in the plurality of partition plates to allow the fluid to flow between the plurality of sub-cavities, and the fluid passage holes comprise gas passage holes in upper regions of the plurality of partition plates and liquid passage holes in lower regions of the plurality of partition plates, wherein bracket units are disposed between the plurality of partition plates adjacent to each other, wherein openings are formed in the bracket units, wherein each of the bracket units comprises:

height bracket parts arranged between the plurality of partition plates in the height direction; and width bracket parts arranged between the plurality of partition plates in the width direction, wherein the plurality of partition plates extend inwardly from inner wall surfaces of the first casing wall in the width and height directions, connect the inner wall surfaces of the first casing wall to each other, and divide the cavity of the first casing wall into the plurality of sub-cavities, and wherein each of the plurality of partition plates comprises a solid center, and the gas and liquid passage holes are located at a peripheral area with respect to the solid center.

2. The fluid storage tank of claim 1, wherein the liquid passage holes are larger than the gas passage holes.

3. The fluid storage tank of claim 1, wherein the end units comprise reinforcing plate parts arranged to divide spaces between the first casing wall and the outermost partition plates into end spaces.

4. The fluid storage tank of claim 3, wherein the reinforcing plate parts divide the spaces between the first casing wall and the outermost partition plates in the height direction or the width direction.

5. The fluid storage tank of claim 3, wherein the fluid flows between the end spaces formed by the reinforcing plate parts through the fluid passage holes formed in the outermost partition plates.

6. The fluid storage tank of claim 5, wherein the number of the fluid passage holes formed in the outermost partition plates corresponds to the number of the end spaces formed by the reinforcing plate parts.

7. The fluid storage tank of claim 1, wherein the openings have an arch shape on both ends thereof.

8. The fluid storage tank of claim 1, wherein the bracket units comprise:

first bracket units disposed between the outermost partition plates and partition plates closest to the outermost partition plates; and second bracket units disposed between partition plates other than the outermost partition plates, wherein the first and second bracket units have different shapes.

9. The fluid storage tank of claim 8, wherein the first bracket units are opened toward the outermost partition plates.

10. The fluid storage tank of claim 8, wherein flanges are perpendicularly connected to the first bracket units.

11. The fluid storage tank of claim 1, further comprising a second casing wall enclosing the first casing wall.

12. The fluid storage tank of claim 11, further comprising stiffeners inserted through the second casing wall with ends of the stiffeners being exposed.

13. The fluid storage tank of claim 12, wherein other ends of the stiffeners are spaced apart from the first casing wall.

14. The fluid storage tank of claim 1, wherein the first casing wall has a size larger in the length direction than in the width or height direction.

15. The fluid storage tank of claim 1, wherein the end units are respectively disposed on both lateral inner wall surfaces of the first casing wall.

16. The fluid storage tank of claim 1, wherein edges or corners of the first casing wall are rounded or angled.

17. The fluid storage tank of claim 1, wherein tubes or manhole covers are arranged on the first casing wall.

18. The fluid storage tank of claim 1, wherein the plurality of partition plates are arranged at different intervals.

* * * * *